United States Patent [19]

Bayh, III

[11] Patent Number: 4,529,035

[45] Date of Patent: Jul. 16, 1985

[54] SUBMERSIBLE PUMP INSTALLATION, METHODS AND SAFETY SYSTEM

[75] Inventor: Russell I. Bayh, III, Carrollton, Tex.

[73] Assignee: Otis Engineering Corporation, Dallas, Tex.

[21] Appl. No.: 470,581

[22] Filed: Feb. 28, 1983

[51] Int. Cl.[3] ..... E21B 43/12; E21B 34/08

[52] U.S. Cl. ..... 166/106; 166/322; 166/212

[58] Field of Search ..... 166/105, 106, 382, 321, 166/322, 326, 217, 212

[56] References Cited

U.S. PATENT DOCUMENTS

| | | | |
|---|---|---|---|
| 3,208,531 | 9/1965 | Tamplen | 166/125 |
| 3,853,430 | 12/1974 | O'Rourke | 417/360 |
| 3,990,511 | 11/1976 | Gazda | 166/224 |
| 4,009,756 | 3/1977 | Zehren | 166/106 |
| 4,049,052 | 9/1977 | Arendt | 166/183 |
| 4,121,659 | 10/1978 | Taylor | 166/129 |
| 4,128,127 | 12/1978 | Taylor | 166/105 |
| 4,134,454 | 1/1979 | Taylor | 166/320 |
| 4,294,315 | 10/1981 | Yonker | 166/322 |
| 4,313,495 | 2/1982 | Brandet | 166/105 |
| 4,350,205 | 9/1982 | Goldschild et al. | 166/321 |
| 4,352,394 | 10/1982 | Zehren | 166/106 |
| 4,354,554 | 10/1982 | Calhoun | 166/322 |
| 4,399,873 | 8/1983 | Lindsey, Jr. | 166/217 |

FOREIGN PATENT DOCUMENTS

| | | | |
|---|---|---|---|
| 2083524 | 3/1982 | United Kingdom | 166/105 |

*Primary Examiner*—Stephen J. Novosad
*Assistant Examiner*—Bruce M. Kisliuk
*Attorney, Agent, or Firm*—Thomas R. Felger

[57] ABSTRACT

A landing nipple and safety system for installation in wells having a submersible pump for pumping well fluids to the surface plus a subsurface safety valve for maintaining the well under control during installation and removal of the pump from the well. The subsurface safety valve is hydraulically actuated by the discharge pressure of the pump. The landing nipple on which the pump is mounted and in which the safety valve is installed can be retrieved from the flow conductor by conventional wireline techniques.

10 Claims, 21 Drawing Figures

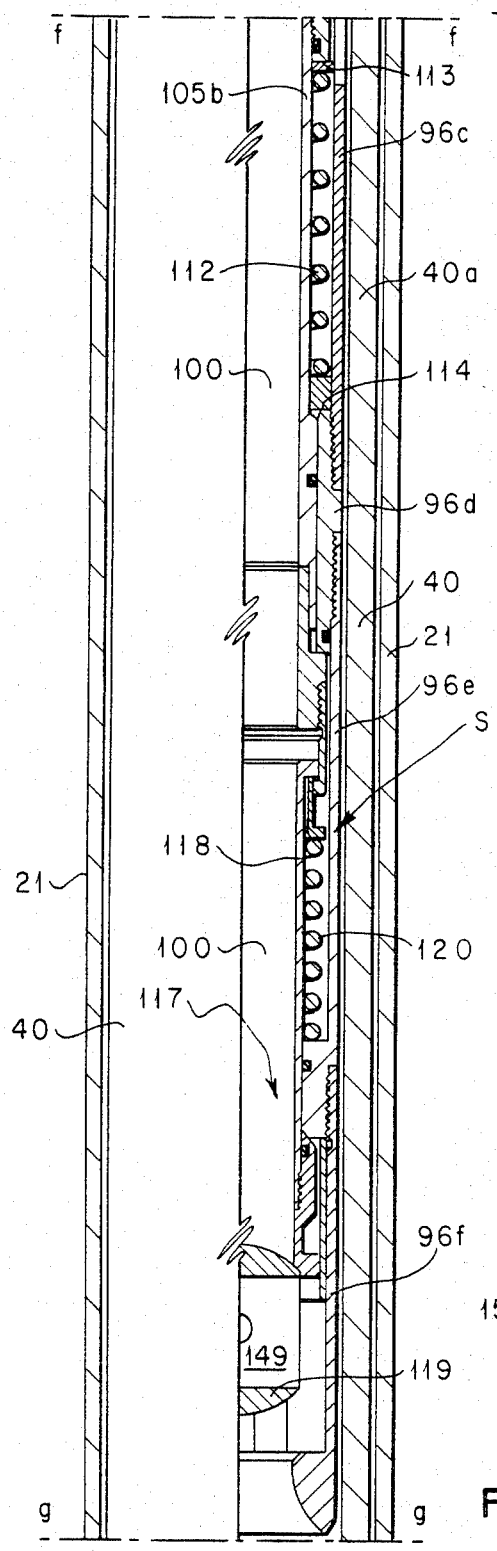
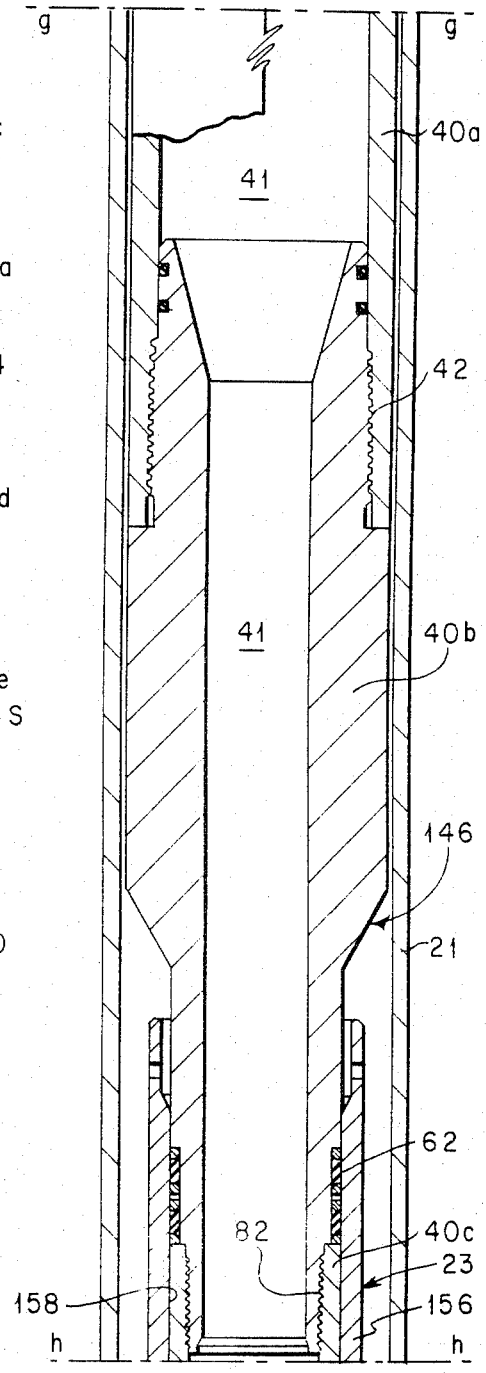
FIG. 2H
FIG. 2G

SUBMERSIBLE PUMP INSTALLATION, METHODS AND SAFETY SYSTEM

BACKGROUND OF THE INVENTION

1. Field of the Invention

This invention relates to submersible pump installations for wells and to a safety system which maintains the well under control.

2. Description of the Prior Art

In some hydrocarbon producing formations, sufficient reservoir pressure may be present to cause formation fluids to flow to the well surface. However, the hydrocarbon flow resulting from the natural reservoir pressure may be significantly lower than the desired flow. For these types of wells, electrically powered submersible pumps are sometimes installed to achieve the desired hydrocarbon flow rate. Submersible pumps can be used to raise various liquids to the well surface. Examples of prior art submersible pump and safety valve installations are shown in U.S. Pat. Nos. 3,853,430; 4,121,659; 4,128,127 and 4,134,454. Copending U.S. patent applications Ser. No. 186,980 filed Sept. 15, 1980 and Ser. No. 306,035 filed June 7, 1982 disclose improved safety systems for use with submersible pumps. The preceding patents and patent applications are incorporated by reference for all purposes within this application.

SUMMARY OF THE INVENTION

The present invention discloses a well completion having a submersible pump with an intake and a discharge disposed within a well flow conductor comprising packer means for forming a fluid seal with the interior of the flow conductor at a downhole location to direct fluid flow to the pump intake; a landing nipple releasably secured to the upper portion of the packer means; a longitudinal passageway extending through the landing nipple; a safety valve releasably secured within the longitudinal passageway for controlling fluid flow therethrough; means for attaching the submersible pump to the landing nipple above the safety valve; and the longitudinal passageway providing a portion of the means for directing fluid flow to the pump intake.

One object of the invention is to provide a submersible pump installation having a safety system including a subsurface safety valve which is controlled by hydraulic pressure from the pump discharge.

Another object of the invention is to provide a landing nipple for installing a submersible pump and a safety valve at a downhole location. The submersible pump, safety valve, and landing nipple are retrievable from within the flow conductor. The safety valve blocks fluid flow to the well surface when the submersible pump is not operating and when the submersible pump has been retrieved from the landing nipple.

A further object of the invention is to provide a submersible pump installation including a universal landing nipple in which various submersible pumps and safety valves can be mounted.

A still further object of the invention is to provide a landing nipple which can be releasably secured to various well packers.

Additional objects and advantages of the invention will be readily apparent to those skilled in the art from reading the following description in conjunction with the drawings and claims.

BRIEF DESCRIPTION OF THE DRAWINGS

FIGS. 2A–J are partially in section and partially in elevation showing the submersible pump attachments and safety system of FIG. 1 disposed within a casing string. The safety system is shown in its first or closed position blocking fluid flow through the packer mandrel.

DESCRIPTION OF THE PREFERRED EMBODIMENTS

Figure 1A:
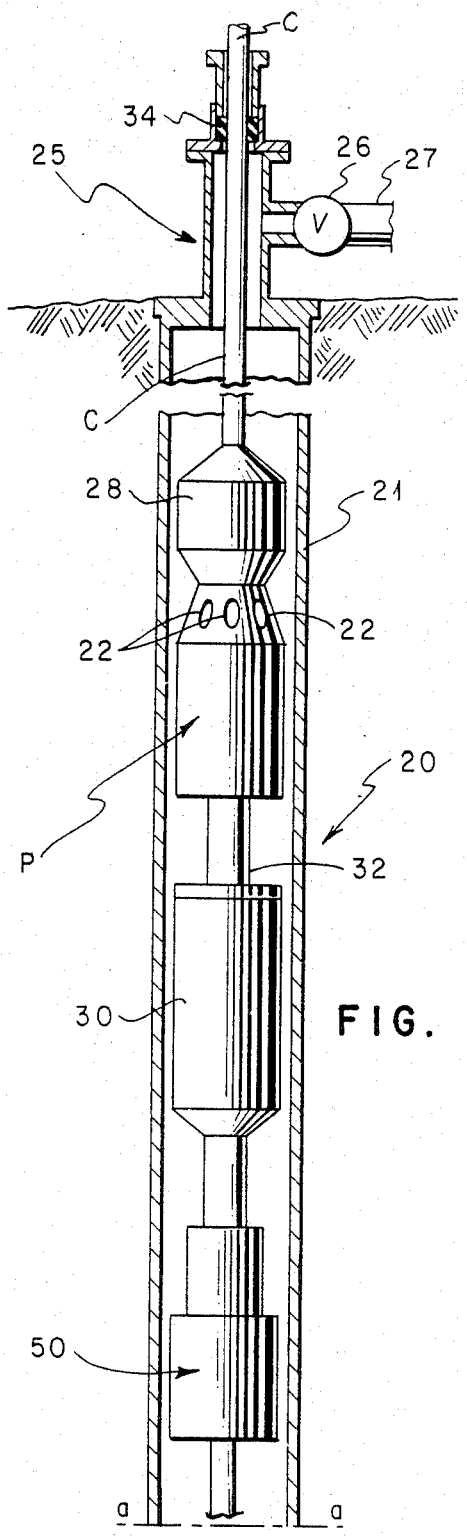
FIGS. 1A and 1B are schematic views partially in longitudinal section and partially in elevation showing a well completion with a submersible pump and safety system of the present invention
Figure 1B:
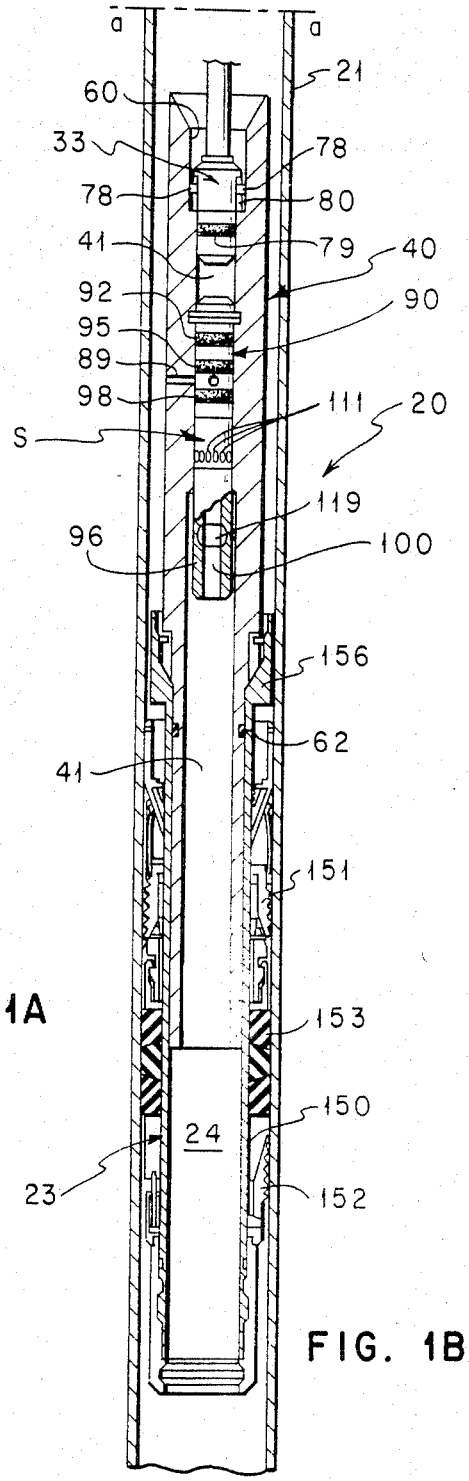

A submersible pump installation and safety system incorporating the present invention are schematically illustrated in FIGS. 1A and 1B. Well 20 is partially defined by casing or flow conductor 21 which extends from wellhead 25 to a producing formation (not shown). Couplings 21*a* are used to connect the joints of casing 21 with each other. Well packer means 23 with packer bore 24 extending therethrough forms a fluid barrier with the interior of casing 21 to direct fluid flow from the producing formation to the well surface via packer bore 24. Valve 26 controls production fluid flow from wellhead 25 into surface flowline 27.

To increase production fluid flow, submersible pump P is shown suspended within flow conductor 21 by electrical cable C. Pump P is driven by electrical motor 28 to discharge formation fluids from outlets or discharge ports 22 into the bore of casing 21 above packer 23. Accumulator means 30 is attached to and extends downwardly from pump inlet 32. Preferably, travel joint 50 is attached below accumulator means 30. Pump support means or seating mandrel 33 is attached below travel joint 50. The weight of pump P, motor 28, accumulator means 30 and travel joint 50 is supported partially by the contact between seating mandrel 33 and landing nipple 40 and partially by cable C. Cable C also supplies electrical power from the well surface to motor 28. Wellhead 25 includes packing means 34 which forms a fluid barrier around cable C and prevents undesired fluid flow therepast. Pump P, motor 28, and cable C are commercially available from various companies. One such company is REDA Pump Division of TRW in Bartlesville, Okla.

Bore 43 extends longitudinally through pump inlet 32, accumulator means 30, swivel connector means 29, travel joint 50 and pump seating mandrel 33. Bore 43 provides a flow path for formation fluids to enter pump P. Bore 43 is given an alphabetic designation within each component attached to pump P to aid in describing the invention. As shown in FIGS. 2A–2D, appropriately sized o-rings are included within each connection between the various components attached to pump P to prevent undesired fluid communication between bore 43 and the exterior of the components.

Figure 2A:
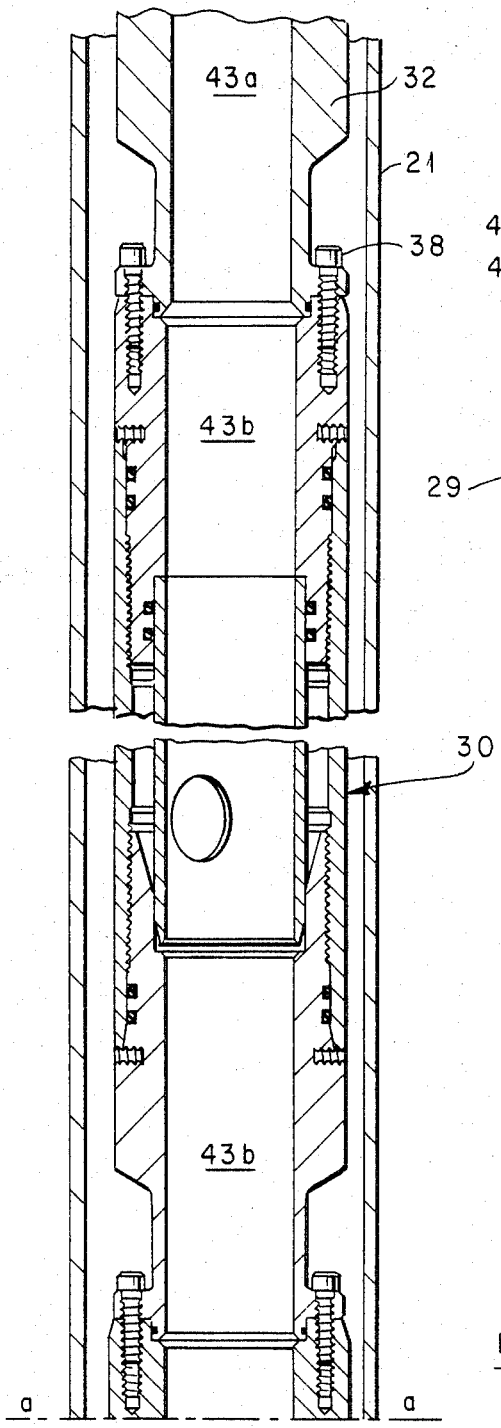
Figure 2B:
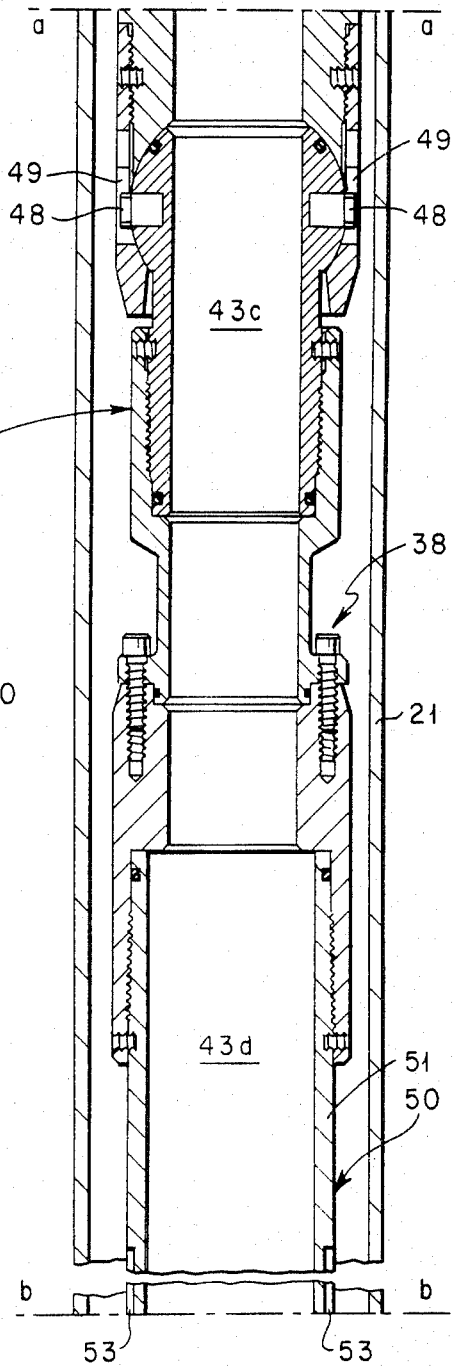
Figure 2C:
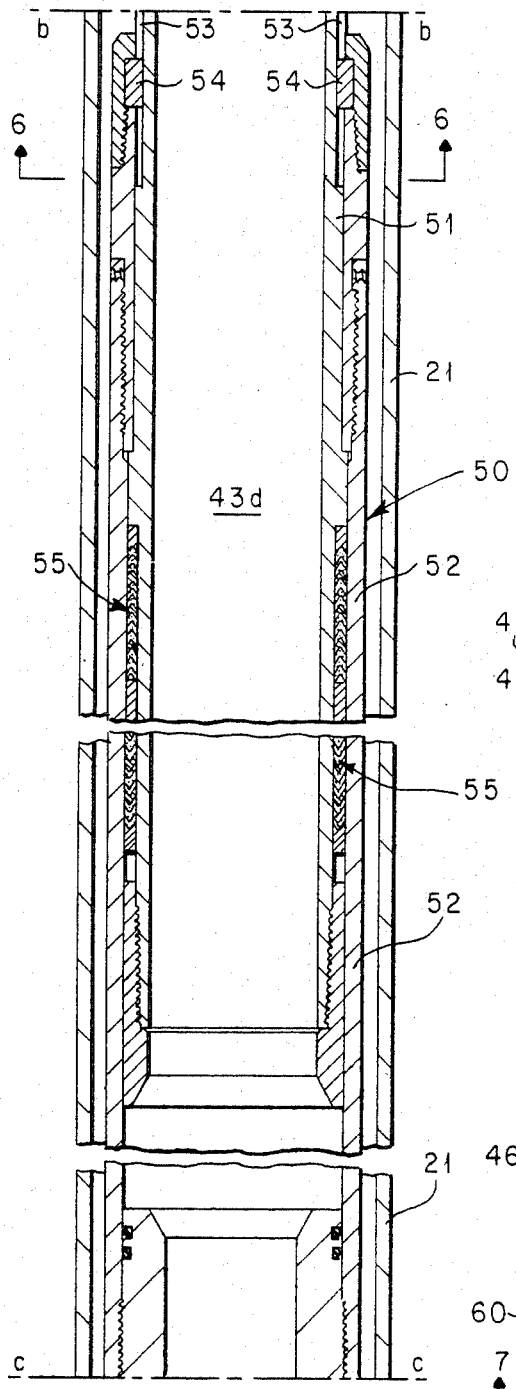
Figure 2D:
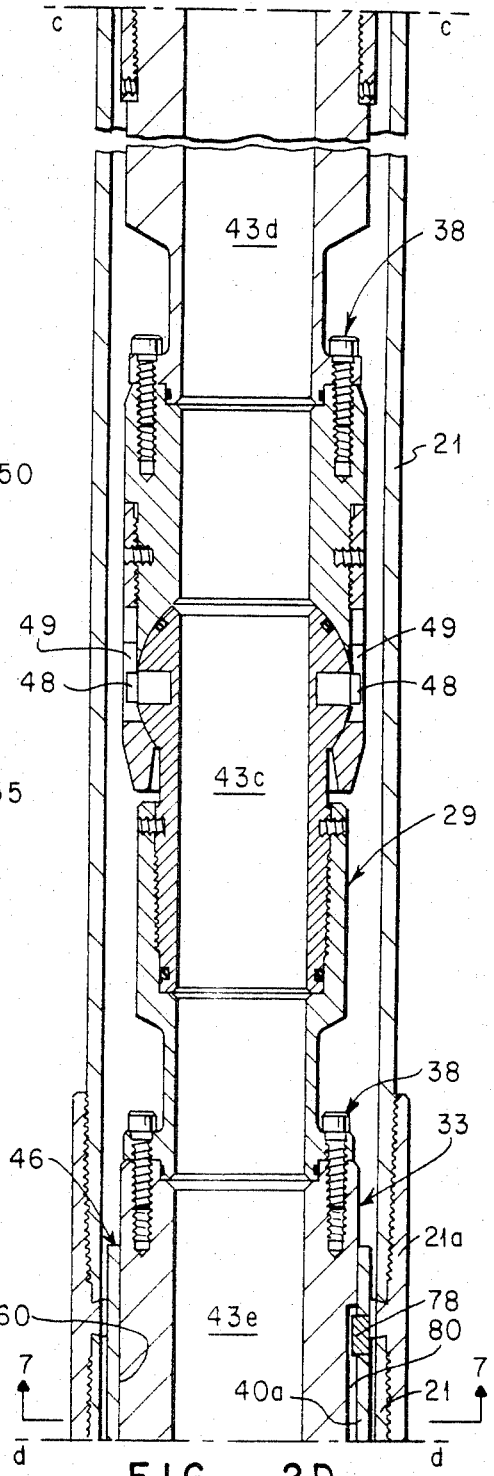
Figure 2E:
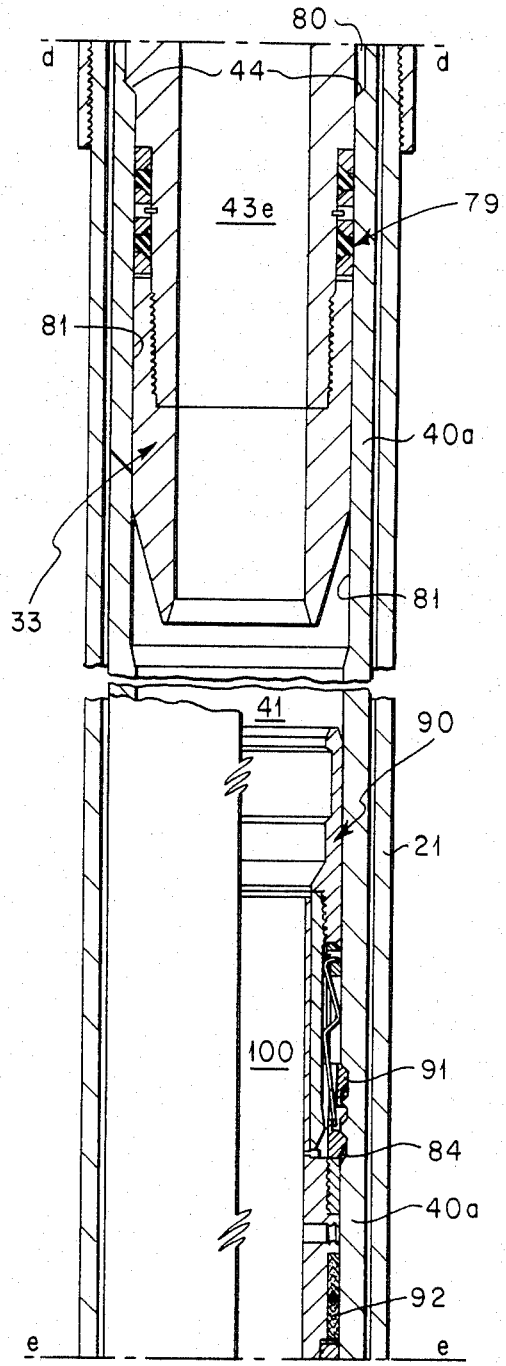

Pump inlet 32 is attached by bolted connection 38 to accumulator 30 as shown in FIG. 2A. One advantage of the present invention is that various submersible pumps can be attached to inlet 32 and satisfactorily installed within casing 21. Also, the components of the submersible pump installation could be connected to each other by means other than bolted connections 38. The total length of the submersible pump installation including motor 28, pump P, accumulator means 30, travel joint 50 and seating mandrel 33 requires the use of swivel connector means 29 between various components. Swivel connector means 29 compensate for deviations of casing 21 while raising and lowering pump P and attached components. Swivel connector means 29 may also be classified as a flexible joint or articulated joint. Installing several swivel connector means 29 allows limited flexing of the components relative to each other while installing and retrieving pump P. However, swivel connector means 29 are designed to prevent rotation of the components attached thereto relative to each other. Swivel connector means 29 allows accumulator means 30 and travel joint 50 to flex relative to each other in one plane as determined by keys 48 and keyways 49. In the same manner, a swivel connector means 29 is preferably installed between travel joint 50 and seating mandrel 33 as shown in FIGS. 2C and 2D.

When pump P is turned off, safety valve S will close. Accumulator means 30 communicates with pump inlet 32 to supply a reservoir of fluid to allow discharge pressure from pump P to open safety valve S when pump P is turned on. Swivel connector means 29 allows the attachment of as many accumulator means 30 as required for each submersible pump installation. In FIG. 1A, only one accumulator means 30 is shown, but others may be added as desired.

Travel joint 50 comprises primarily two long, hollow cylinders 51 and 52. Cylinder 51 is sized to telescope within cylinder 52. Keyways 53 are machined longitudinally into the exterior of cylinder 51. Matching keys 54 are carried by cylinder 52 and slide longitudinally in keyways 53. Keys 54 and keyways 53 cooperate to prevent rotation of cylinders 51 and 52 with respect to each other. Packing means 55 is carried on cylinder 51 near its extreme end disposed within cylinder 52. Packing means 55 forms a fluid barrier with the adjacent inside diameter of cylinder 52 as cylinders 51 and 52 telescope longitudinally relative to each other. Travel joint 50 is preferably installed with cylinder 51 telescoped approximately 50% into cylinder 52. This results in cable C carrying the weight of pump P and the components above cylinder 51. This weight maintains cable C taut without overstressing it. The weight of cylinder 52 and the components therebelow is supported by contact between seating mandrel 33 and landing nipple 40. The extreme ends of travel joint 50 have appropriate bolted connections 38 for attachment to adjacent components.

Seating mandrel 33, attached to travel joint 50 by a swivel connector means 29, is a relatively short hollow cylinder with bore **43*e* extending therethrough. Packing means 79 are carried on the exterior of seating mandrel 33 below keyways 80. Packing means 79 are sized to form a fluid barrier with inside diameter 81 of landing nipple 40. Packing means 79 blocks fluid discharged from pump outlets 22 from flowing downwardly through longitudinal passageway 41 of landing nipple 40. A plurality of keyways 80 extend longitudinally through a portion of the exterior of seating mandrel 33. Matching keys 78 project radially inward from the interior of longitudinal passageway 41 and engage keyways 80. Keys 78 and keyways 80 cooperate to prevent rotation of seating mandrel 33 and landing nipple 40 relative to each other. Various mechanisms other than keys 78 and keyways 80 could be used to secure seating mandrel 33 within landing nipple 40** and prevent rotation of the components relative to each other. U.S. patent application Ser. No. 199,034 filed on Oct. 20, 1980 and U.S. Pat. No. 4,121,659 disclose such mechanisms.

Figure 4:
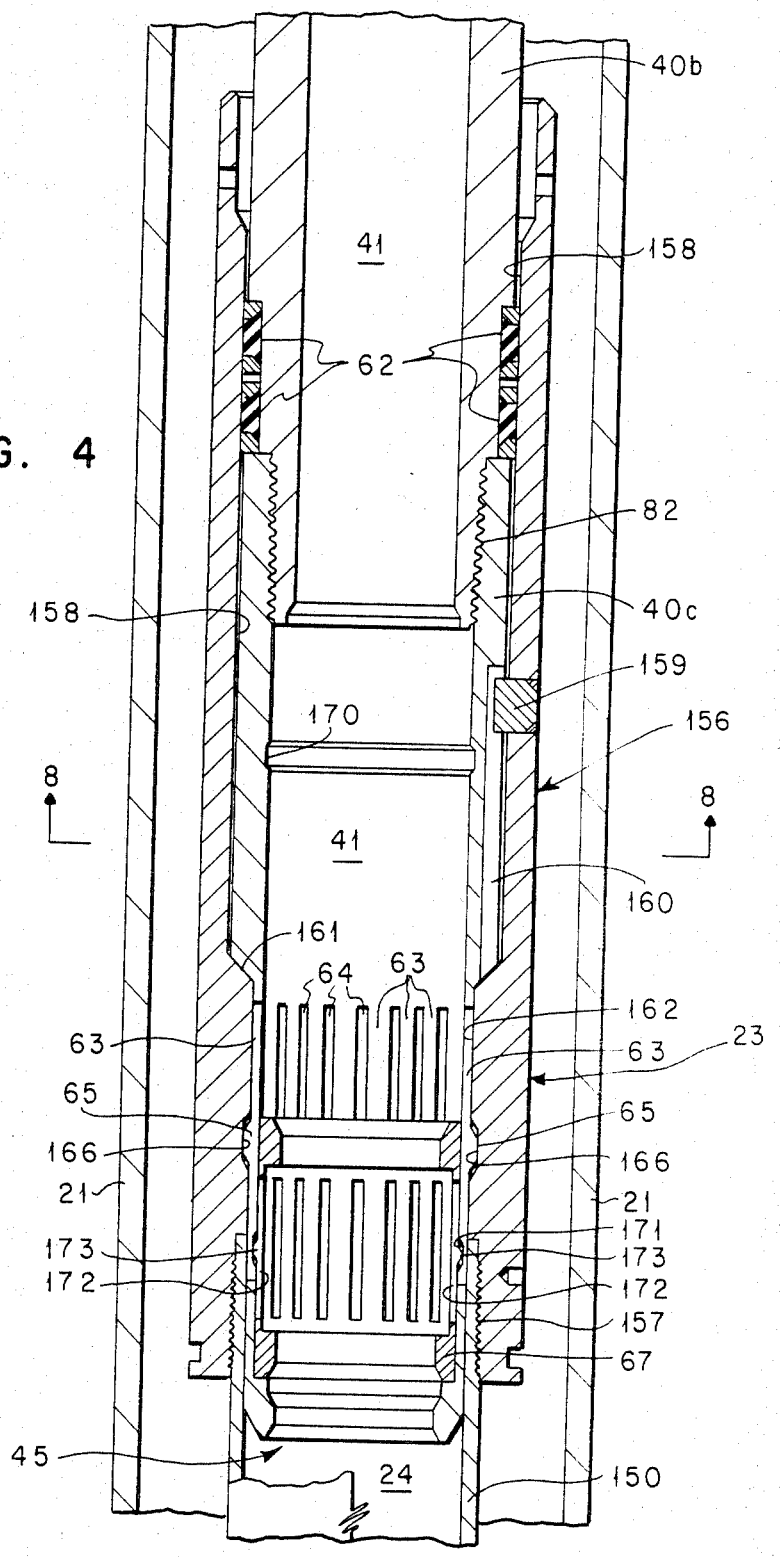
FIG. 4 is an enlarged drawing in longitudinal section showing the engagement between the landing nipple and the well packer.

For ease of manufacture and assembly, landing nipple 40 has an upper section **40*a*, a middle section 40*b* and a lower section 40*c* threadedly engaged to each other. Upper section 40*a* and middle section 40*b* comprise tubular housing means with longitudinal passageway 41 extending therethrough. Section 40*a* is engaged with section 40*b* by threads 42 as shown in FIG. 2H. Upper section 40*a* is shown as a relatively long piece to accommodate both pump seating mandrel 33 and safety valve S. If desired, upper section 40*a* could be manufactured from several shorter hollow tubular sections with appropriate threaded connections to engage the shorter tubular sections with each other. Lower section 40*c* is an adapter sub engaged to middle section 40*b* by threads 82 as shown in FIGS. 2H and 4. Longitudinal passageway 41 extends through lower section 40*c* and communicates with well packer bore 24. A portion of the outside diameter of lower section 40*c* is sized to be received within upper portion 156 of well packer 23. Collet assembly 45 on lower section 40*c* provides means for releasably securing landing nipple 40 with well packer 23 to allow fluid communication between longitudinal passageway 41 and packer bore 24**.

End 46 of upper section **40*a* (the other end of landing nipple 40 opposite from collet assembly 45) is sized to receive seating mandrel 33 partially into longitudinal passageway 41. The portion of longitudinal passageway 41 adjacent to the other end 46 has first inside diameter 60 larger than the inside diameter of the remainder of longitudinal passageway 41. Seating shoulder 44 is formed on the interior of longitudinal passageway 41 by the transition between the inside diameters thereof. Keys 78 project radially inward from first inside diameter portion 60. Honed sealing surface 81 is provided on the interior of longitudinal passageway 41 adjacent to seating shoulder 44. When keys 78 are engaged with keyways 80 and pump seating mandrel 33 is resting on seating shoulder 44, packing means 79 forms a fluid barrier with honed surface 81. A set of locking grooves 84 is machined in the interior of longitudinal passageway 41 in nipple section 40*a* below shoulder 44 to provide part of the means for installing safety valve S within landing nipple 40. U.S. Pat. No. 3,208,531 to J. W. Tamplen discloses a locking mandrel and running tool which can be used to install safety valve S within landing nipple 40**.

As best shown in FIG. 2H, middle section **40*b* is preferably a heavy, thick walled tubular housing means. The extra weight of this section assists in engaging landing nipple 40 with well packer 23. A portion of middle section 40*b* and all of lower section 40*c* are sized to fit within the upper portion of packer bore 24. Tapered surface 146 on the exterior of middle section 40***b* is formed by the major change in outside diameter of middle section 40*b*.

Packing means 62 are carried on the portion of middle section 40*b* which fits within packer bore 24. Packing means 62 forms a fluid barrier with the interior of well packer 23 adjacent thereto. Lower section or adapter sub 40*c* is attached to middle section 40*b* by threads 82. Collet assembly 45 carried near the extreme end of adapter sub 40*c* provides means for releasably locking adapter sub 40*c* to well packer 23.

The releasable locking means includes flexible collet fingers 63 formed in the exterior of adapter sub 40*c* by longitudinal slots 64 as best shown in FIG. 4. Bosses 65 project radially outward from each collet finger 63 intermediate the ends thereof. Bosses 65 are sized to engage annular groove 166 within packer bore 24. Sleeve 67 is slidably disposed within adapter sub 40*c*. Sleeve 67 has a first position which prevents fingers 63 from flexing and a second position which allows fingers 63 to flex radially inward to release landing nipple 40 from well packer 23. Sleeve 67 has a plurality of collet fingers 172 formed through its exterior similar to collet fingers 63. Bosses 173 project radially outward from each collet finger 172 intermediate the ends thereof. The first position of sleeve 67 is defined by bosses 173 engaging annular groove 171 formed on the interior of longitudinal passageway 41. The second position of sleeve 67 is defined by bosses 173 engaging annular groove 170 formed on the interior of longitudinal passageway 41. Annular groove 170 is located above collet fingers 63 such that when sleeve 67 is engaged with annular groove 170, collet fingers 63 are free to flex radially inward. Conventional wireline techniques and tools can be used to shift sleeve 67 between its first and second position.

Port means 89 extend radially through upper section 40*a* intermediate the ends thereof. The longitudinal spacing of port means 89 relative to locking grooves 84 is selected to allow fluid communication between the exterior of landing nipple 40 and safety valve S installed within longitudinal passageway 41. Fluid pressure from pump discharge ports 22 is communicated with port means 89 via the annulus formed by the interior of casing 21 and the exterior of landing nipple 40. Preferably, well packer 23 and the components attached thereto are located within casing 21 such that a liquid level is always maintained above discharge ports 22. This liquid level is required for satisfactory operation of safety valve S.

Locking mandrel 90 carries dogs 91 which coact with grooves 84 to anchor safety valve S within longitudinal passageway 41. Sealing means 92 are carried on the exterior of locking mandrel 90 to form a first fluid barrier with the inside diameter of nipple section 40*a* when dogs 91 are secured within grooves 84. Equalizing assembly 93 is attached to locking mandrel 90. Sealing means 95 are carried on the exterior of equalizing assembly 93 to form a second fluid barrier with the inside diameter of nipple section 40*a*. Sealing means 92 and 95 are spaced longitudinally from each other. Valve housing means 96 is engaged by threads 97 to equalizing assembly 93. Sealing means 98 are carried on the exterior of housing means 96 to form a third fluid barrier with the interior of nipple section 40*a*.

Safety valve S includes locking mandrel 90, equalizing assembly 93, valve housing means 96 and the valve components disposed therein. Bore 100 extends longitudinally through safety valve S. Sealing means 92 and 98 cooperate to direct formation fluid flow through bore 100 and block fluid flow between the exterior of valve S and the interior of nipple 40. When the submersible pump installation is operating normally, formation fluids flow from perforations (not shown) into pump P via packer bore 24, longitudinal passageway 41, bore 100, and bore 43.

Figure 2F:
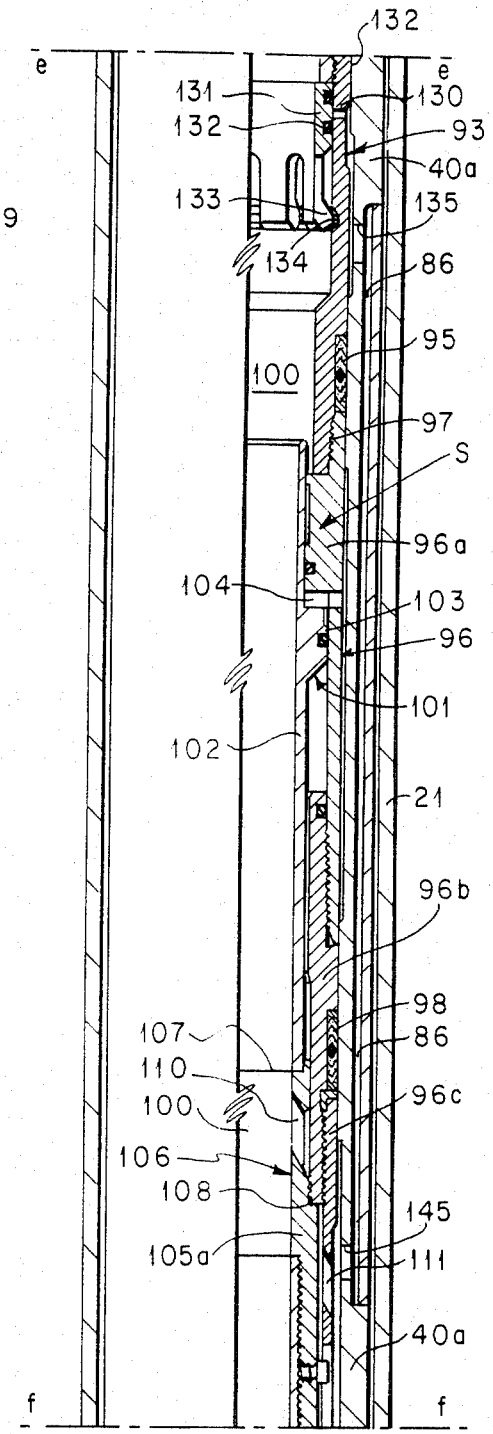
Figure 5A:
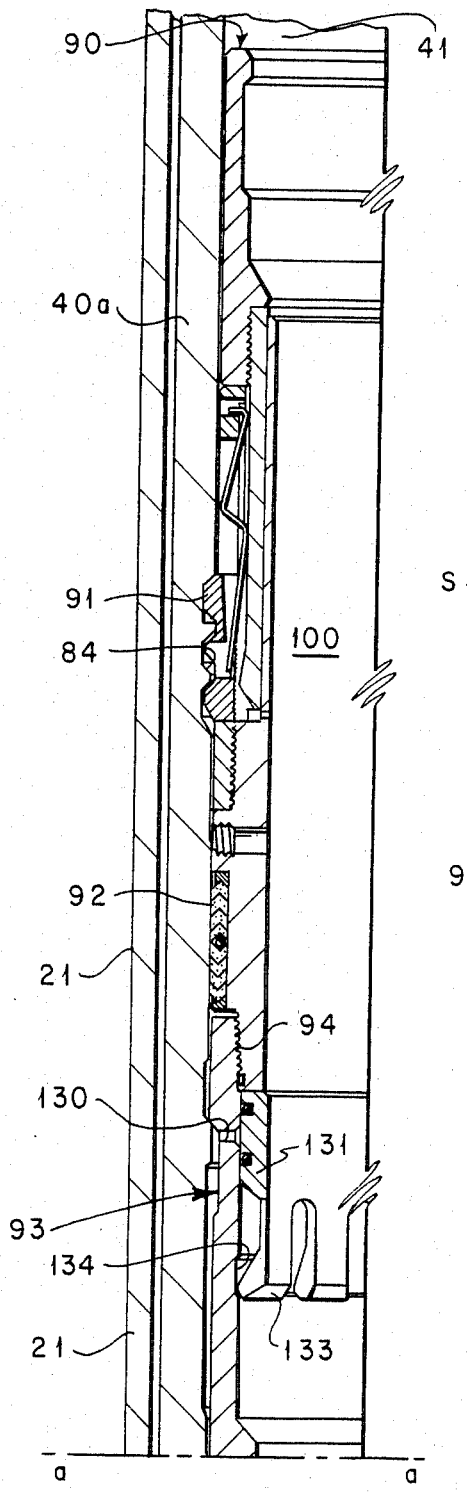
FIGS. 5A–D are drawings in longitudinal half-section with portions broken away showing the safety system of FIG. 1 in its second or open position allowing fluid flow through the flow conductor.
Figure 5B:
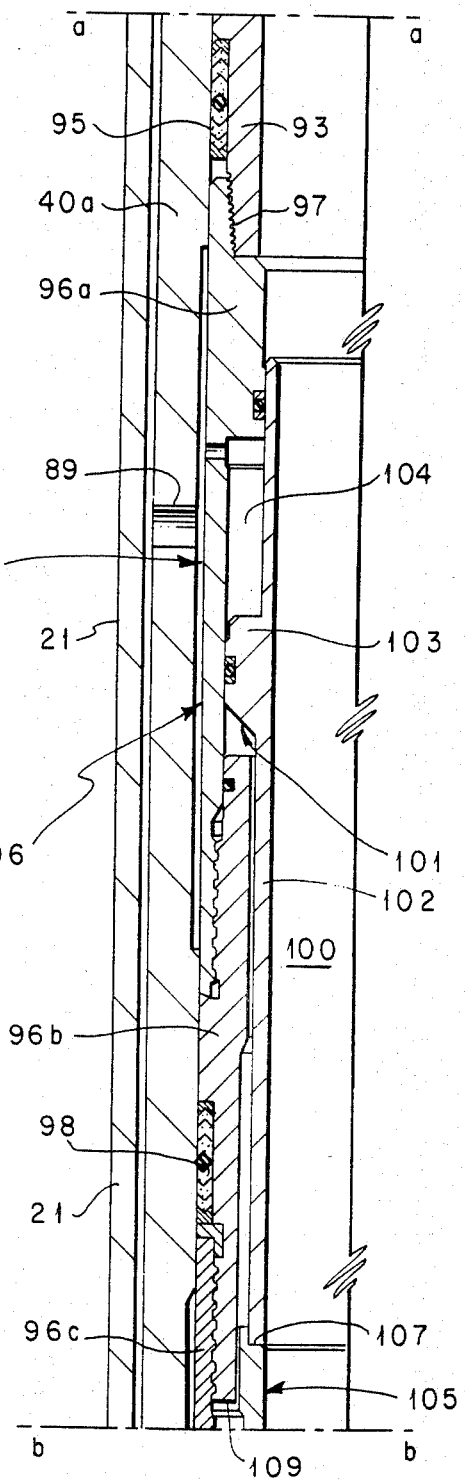
Figure 5C:
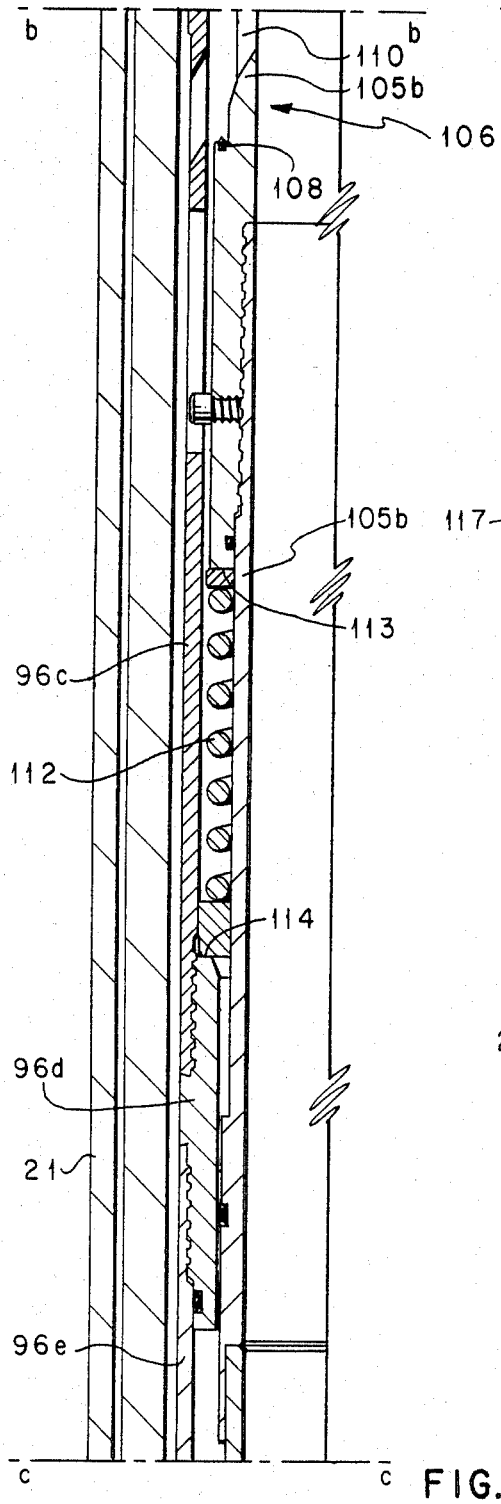

Valve housing means 96 consists of several concentric, hollow sleeves which are connected by threads to each other. Each housing means subassembly has an alphabetic designation. Hydraulically actuated means 101 comprising operating sleeve 102 and piston 103 are slidably disposed within bore 100. Increasing fluid pressure in variable volume chamber 104 will cause operating sleeve 102 to slide longitudinally relative to housing means 96. Inner cylinder 105, which has two subsections designated 105*a* and 105*b*, of poppet valve means 106 abuts the extreme end of operating sleeve 102 at 107. Elastomeric seal 108 is carried on the exterior of inner cylinder 105 intermediate the ends thereof. Metal seating surface 109 is provided on the interior of housing means 96 facing elastomeric seal 108. A plurality of openings 110 extends radially through inner cylinder section 105*a*. Another plurality of openings 111 extends radially through housing subassembly 96*c*. When safety valve S is in its first position as shown in FIG. 2F, elastomeric seal 108 contacts metal seating surface 109 blocking fluid communication through openings 110 and 111. When operating sleeve 102 slides longitudinally in one direction, it will contact inner cylinder 105 and displace elastomeric seal 108 away from metal seating surface 109. This displacement allows fluid communication through openings 110 and 111 as shown in FIG. 5C. Spring 112 disposed between shoulder 113 on the exterior of inner cylinder section 105*b* and shoulder 114 of housing means 96 urges elastomeric seal 108 to contact metal seating surface 109.

Poppet valve means 106 is included within safety valve S because openings 110 and 111 have a large flow area as compared to bore 100. Also, poppet valve means 106 is easily pressure balanced so that less control fluid pressure is required to displace elastomeric seal 108 away from metal seating surface 109 as compared to opening a ball type valve.

Figure 5D:
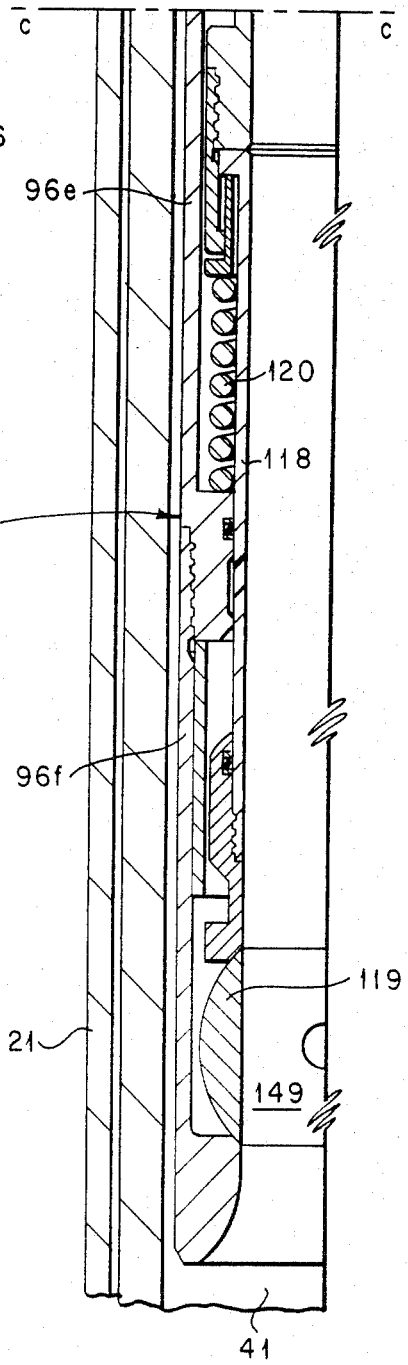
Figure 6:
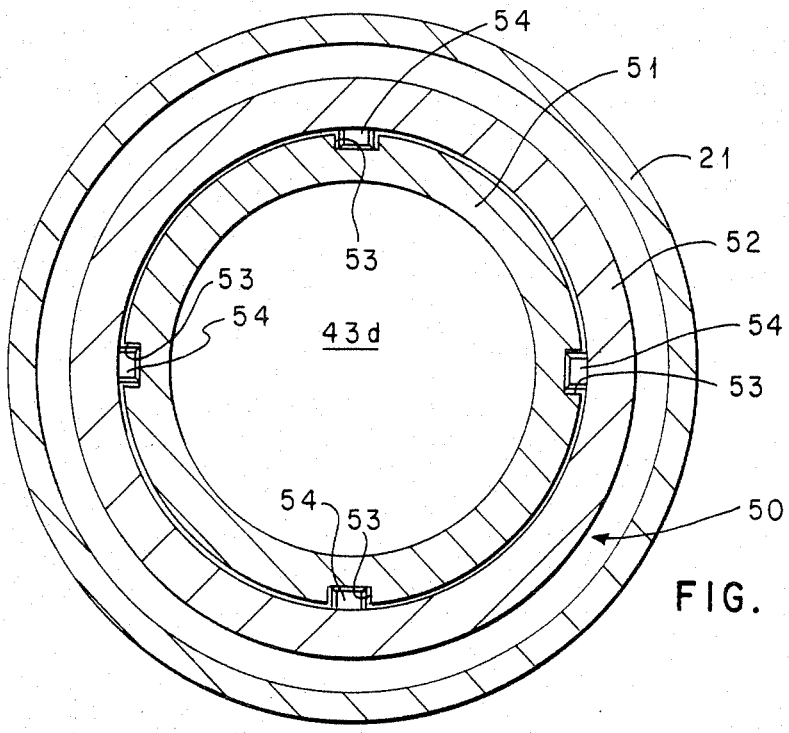
FIG. 6 is a drawing in horizontal section taken along line 6—6 of FIG. 2C.
Figure 8:
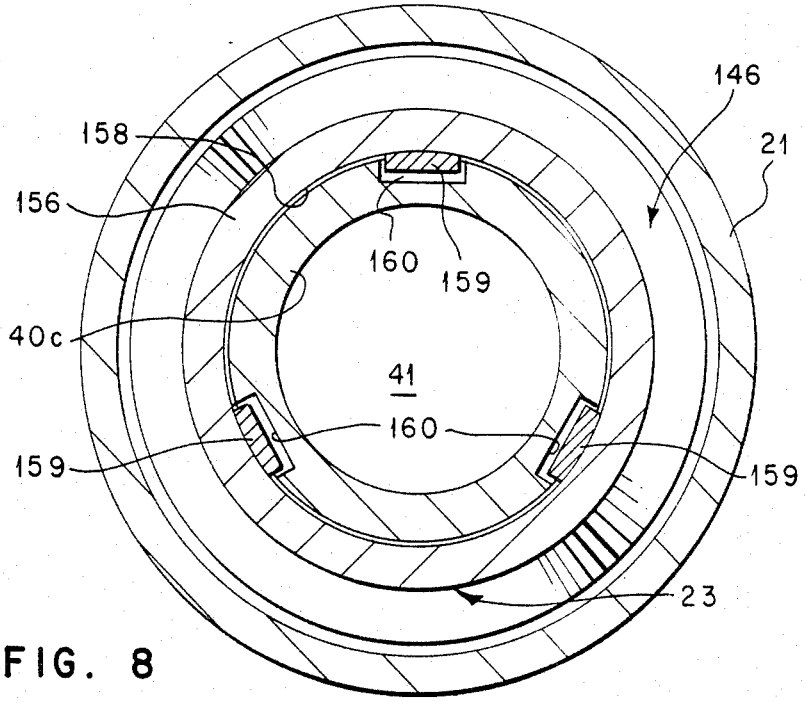
FIG. 8 is a drawing in horizontal section taken along line 8—8 of FIG. 4.
Figure 7:
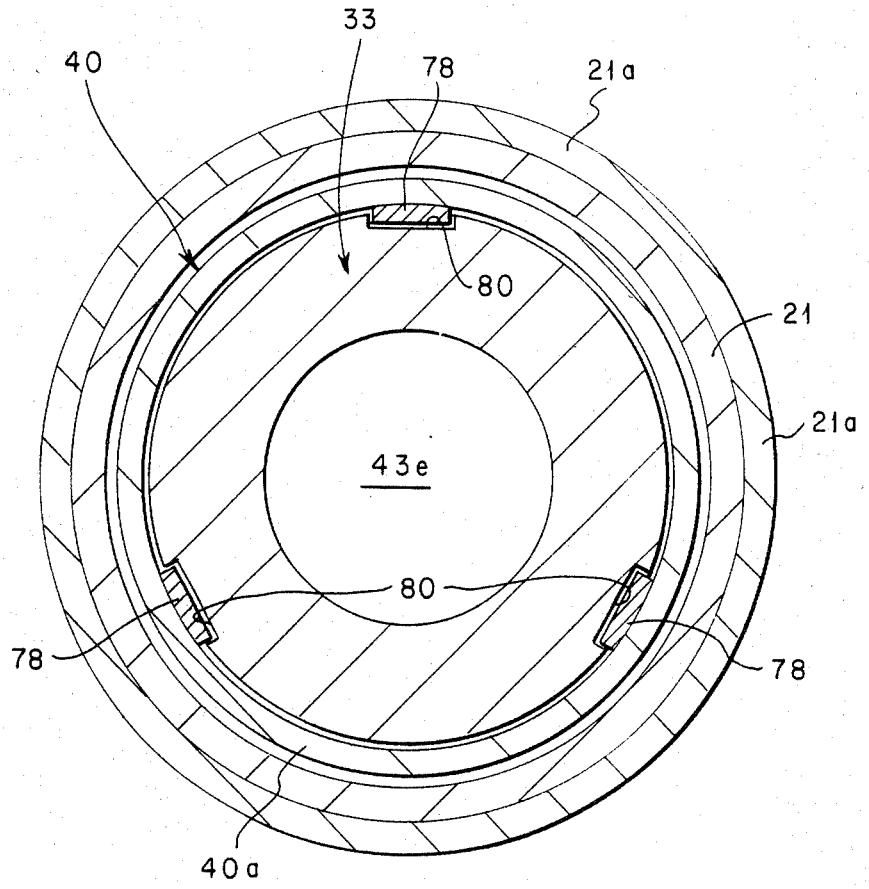
FIGURE 7 is a drawing in horizontal section taken along line 7—7 of FIG. 3.

Ball valve means 117 is disposed within safety valve S below poppet valve means 106. Operating sleeve 118 of ball valve means 117 is spaced longitudinally away from inner cylinder section 105*b* when poppet valve means 106 is closed. When piston 103 shifts poppet valve means 106 to its open position, inner cylinder section 105*b* will contact operating sleeve 118 to rotate ball 119 to align bore 149 of ball 119 with bore 100 as shown in FIG. 5D. Ball valve means 117 is open when bore 149 is aligned with bore 100. Ball valve means 117 is shut when bore 149 is rotated normal to bore 100. Spring 120 urges ball 119 to rotate to block bore 100 when fluid pressure is released from variable volume chamber 104.

Ball valve means 117 is a normally closed safety valve which is opened by inner cylinder section 105*b* of poppet valve means 106 contacting operating sleeve 118. Both poppet valve means 106 and ball valve means 117 operate in substantially the same manner as other surface controlled subsurface safety valves. Control fluid pressure is applied to piston 103 to shift safety valve S to its second or open position. When control fluid pressure is released from variable volume chamber 104, springs 112 and 120 cooperate to return safety valve S to its first or closed position blocking fluid flow through bore 100. As will be explained later, control fluid pressure acting on piston means 103 is supplied from the discharge of pump P.

Since inner cylinder section 105*b* is spaced longitudinally from operating sleeve 118 when safety valve S is in its first position, poppet valve means 106 will open first when pump P is started. Well fluids will initially flow into bore 100 above ball 119 through openings 110 and 111 to equalize any pressure difference across ball 119 and to supply well fluids to pump inlet 32. Thus, accumulator means 30 must contain at least enough fluid to open poppet valve means 106. Also, equalizing the pressure difference across ball 119 prior to rotating ball 119 significantly reduces the force required to open ball valve means 117 and minimizes the possibility of damage to safety valve S. If desired, a flapper valve could be substituted for ball valve means 117. Copending U.S. patent application Ser. No. 186,980 filed on Sept. 15, 1980 fully explains the operation of safety valve S.

Equalizing assembly 93 is positioned within safety valve S between locking mandrel 90 and valve housing means 96. Equalizing assembly 93 provides means for selectively equalizing fluid pressure between bore 100 and the exterior of safety valve S while installing and removing safety valve S from longitudinal passageway 41. A plurality of apertures 130 extend radially through equalizing assembly 93. Sliding sleeve 131 with a pair of o-ring seals 132 carried on its exterior is disposed within equalizing assembly 93. 0-ring seals 132 are spaced from each other so that when sleeve 131 is in its first or upper position, o-ring seals 132 will straddle apertures 130 blocking fluid flow therethrough. Collet fingers 133 are carried by sleeve 131 to engage groove 134 and hold sleeve 131 in its first position. Various wireline tools are commercially available which can be lowered from the well surface through casing 21, after pump P has been removed, to shift sleeve 131 to either open or block apertures 130.

Longitudinal flow path 86 is provided in the exterior of landing nipple 40 to communicate well fluids from below sealing means 98 to equalizing assembly 93. Radial port 135 extends from longitudinal passageway 41 through nipple 40 to the upper end of longitudinal flow path 86. Radial port 135 is positioned adjacent to apertures 130 between sealing means 92 and 95. Therefore, control fluid or pump discharge fluid is blocked by sealing means 95 from communicating with longitudinal flow path 86. The lower end of longitudinal flow path 86 communicates with longitudinal passageway 41 below packing means 98 through openings 145.

Figure 2I:
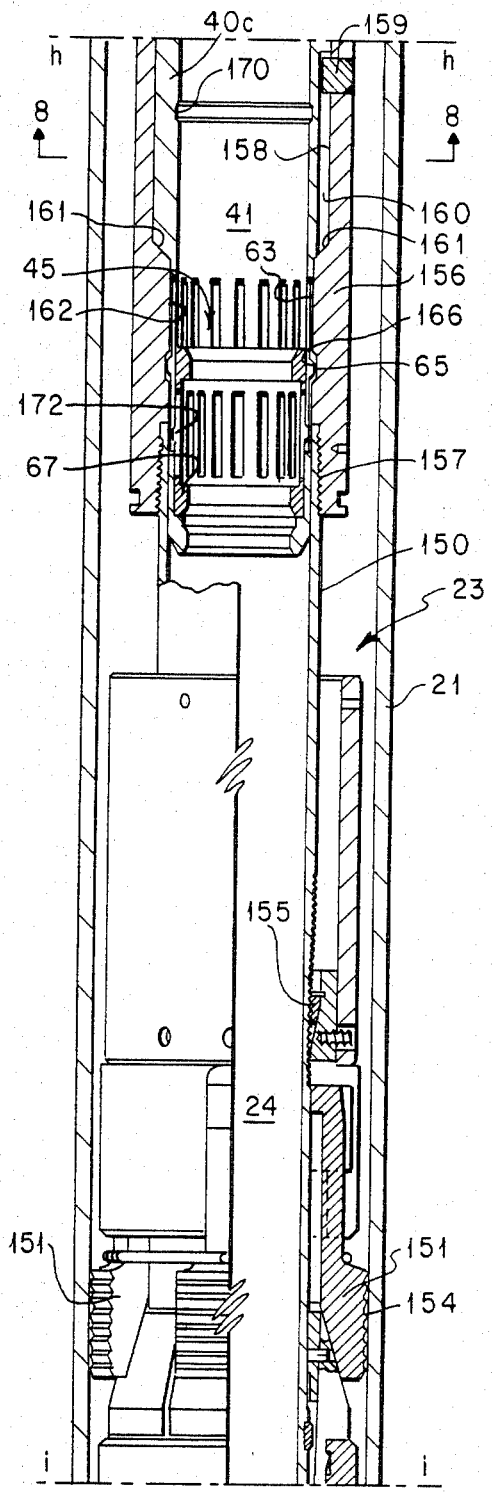
Figure 2J:
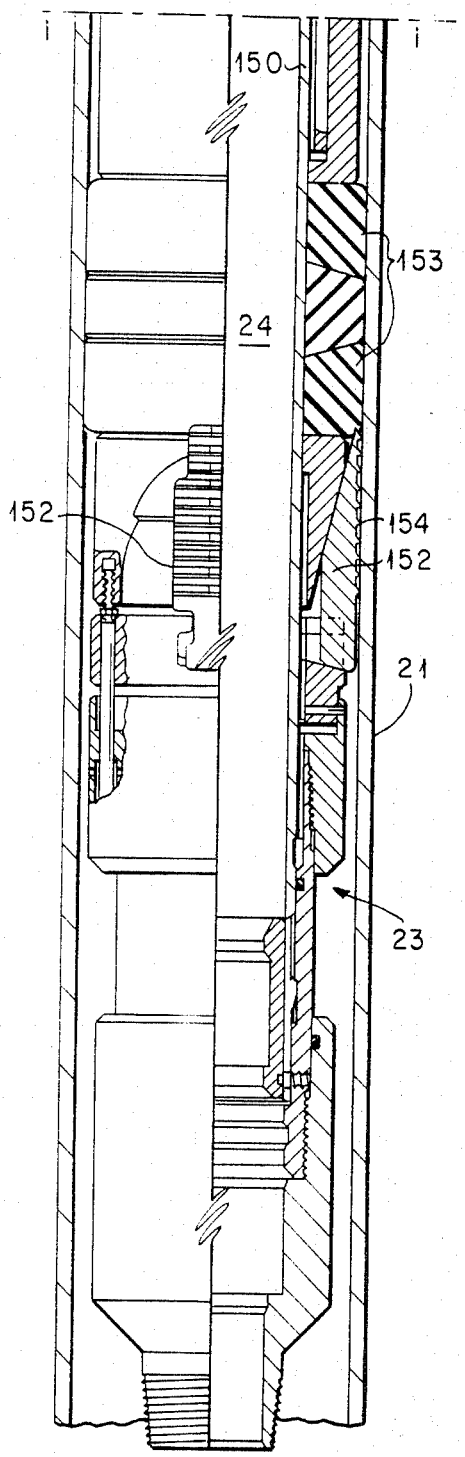
Figure 3:
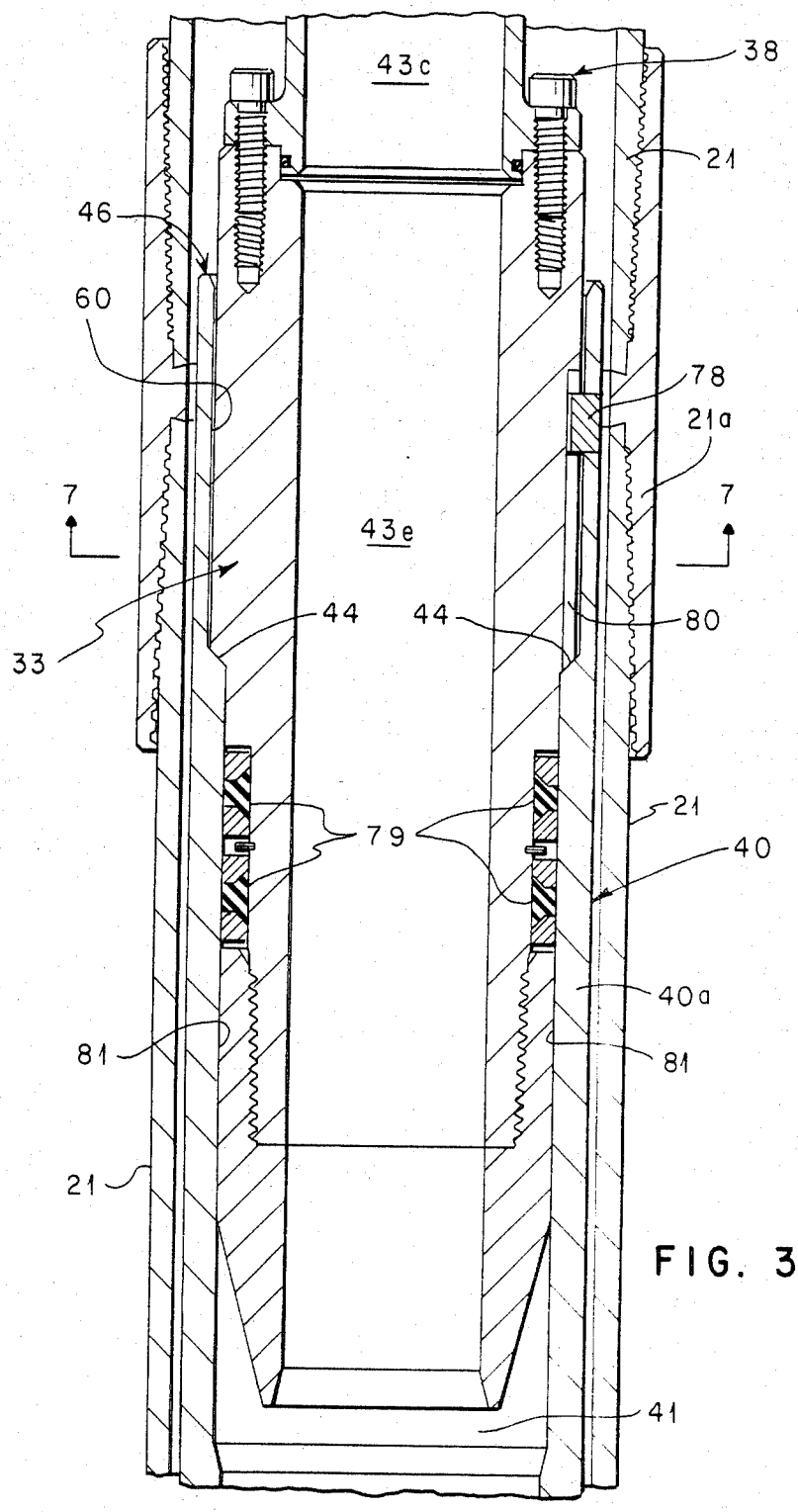
FIG. 3 is an enlarged drawing in longitudinal section showing the engagement between the pump seating mandrel and the landing nipple of the present invention.

A wide variety of commercially available production well packers can be used with the present invention. The only requirement is that the upper portion of the well packer must be modified to allow releasably securing landing nipple 40 therein. Well packer means 23 as shown in FIGS. 1B, 2I and 2J is set by a commercially available electric setting gun and can be retrieved from its downhole location if desired. Packers set by other techniques and permanently set packers may also be used.

The various components which comprise well packer means 23 are carried by and assembled on packer mandrel 150. Packer bore 24 extends longitudinally through packer mandrel 150. Slip elements 151 and 152 are slidably disposed on the exterior of packer mandrel 150 with packing elements 153 therebetween. Well packer means 23 is installed at the desired downhole location within flow conductor 21 by radially expanding slip elements 151 and 152 to cause teeth 154 on the exterior of each slip element to bite into the interior of flow conductor 21 adjacent thereto. Packing means 153 is also compressed and radially expanded to form a fluid barrier between the exterior of packer mandrel 150 and the interior of flow conductor 21. Internal slip segments 155 hold slip elements 151 and 152 and packing means 153 in their radially expanded or set position.

Upper portion 156 of well packer means 23 comprises an extension of packer mandrel 150 with packer bore 24 extending therethrough. Upper portion 156 could be engaged by threads 157 to the packer mandrel of various commercially available production well packers.

Inside diameter 158 of packer bore 24 within upper portion 156 is enlarged to receive the lower end of landing nipple 40 or lower section 40*c* therein. A plurality of keys 159 projects radially inward from inside diameter 158 to engage matching keyways 160 in the exterior of lower section 40*c*. Shoulder 161 is formed on the interior of packer bore 24 by the transition from inside diameter 158 to reduced inside diameter 162 of upper portion 156. Inside diameter 158 preferably has a honed sealing surface adjacent to keys 159 to form a fluid barrier with packing means 62 on the exterior of landing nipple 40. Groove 166 is formed within inside diameter 162 to receive bosses 65 of collet assembly 45 therein.

Torque generated by electrical pump P is transmitted from pump seating mandrel 33 via keys 78 and keyways 80 to landing nipple 40. From landing nipple 40 the torque is transmitted to well packer 23 via keys 159 and keyways 160. The engagement of slip elements 151 and 152 and packing means 153 with flow conductor 21 prevents rotation of well packer 23 relative thereto.

From studying the previous description and related drawings, it is readily apparent that the present invention allows a wide variety of subsurface safety valves to be used with the submersible pump installation. The minimum dimensional requirement for selecting an alternative safety valve is that when the valve is attached to threads 94 of locking mandrel 90, sealing means must be positioned on opposite sides of port means 89 to direct control fluid flow to the safety valve's hydraulically actuated means. The minimum operational requirement for alternative safety valves is that relatively low discharge pressure from pump P must be able to open the safety valve.

INSTALLATION AND OPERATING SEQUENCE

Safety valve S is releasably installed within landing nipple 40 below submersible pump P. Safety valve S can be opened and closed to control the flow of well fluids from the producing formation to the well surface. Pump P and its associated components are not directly attached to safety valve S. Therefore, pump P can be removed from its downhole location for maintenance and/or repair while safety valve S in cooperation with packer 23 blocks undesired formation fluid flow through flow conductor 21 to the well surface. When the complete system is in operation, formation fluids will flow into casing 21 below packer 23 through perforations (not shown). Packer 23 directs the formation fluid flow via packer bore 24 into the lower end of landing nipple 40. Safety valve S in its second or open position allows the formation fluids to continue flowing upwardly through bore 43 of travel joint 50, accumulator means 30 and inlet 32 into pump P. Formation fluids are then pumped to the well surface from discharge ports 22 via casing 21 above well packer 23.

Well packer 23 is installed within flow conductor or casing 21 at the desired downhole location using conventional well completion techniques. Landing nipple 40 is releasably secured to upper portion 156 of well packer 23 by collet assembly 45. Safety valve S is next lowered through flow conductor 21 with equalizing assembly 93 open until locking mandrel 90 is engaged with locking grooves 84 of landing nipple 40. Equalizing assembly 93 is then shut. Springs 112 and 120 cooperate to hold safety valve S in its first position blocking fluid flow to the well surface. Spring 112 holds poppet valve means 106 shut, and spring 120 holds ball valve means 117 shut. Pump P and the components attached thereto can then be lowered through flow conductor 21 until seating mandrel 33 rests on shoulder 44 of landing nipple 40 above safety valve S.

When pump P is turned on, the liquid contained in accumulator means 30 is discharged from pump P to variable volume chamber 104 via port means 89 to open safety valve S. Poppet valve means 106 will open first to increase the supply of liquids to pump inlet 32. Continued operation of pump P will cause further movement of inner cylinder 105 until ball valve means 117 is opened. At this time, well fluids will flow into bore 100 via ball 119 and openings 110 and 111. From bore 100 well fluids will flow through bore 43 into pump inlet 32 and be discharged from outlets 22 to the well surface. The discharge pressure of pump P is applied to variable volume chamber 104 to hold safety valve S open as long as pump P is operating. When pump P is turned off, springs 112 and 120 cooperate to return safety valve S to its first or closed position. Pump P and the components attached thereto may be safely removed from casing 21 when safety valve S is in its first position.

If necessary for well maintenance or workover, safety valve S and landing nipple 40 can be removed from flow conductor 21 by conventional wireline techniques. Thus, the present invention allows for easy repair or replacement of submersible pump P, components attached thereto and the safety system.

The previous description and drawings illustrate only one embodiment of the present invention. Alternative embodiments will be readily apparent to those skilled in the art without departing from the scope of the invention which is defined by the claims.

What is claimed is:

1. A well completion having a submersible pump with an intake and a discharge disposed within a well flow conductor comprising:

a. well packer means for forming a fluid seal with the interior of the well flow conductor at a downhole location to direct fluid flow to the pump intake;
b. a landing nipple releasably secured to the upper portion of the well packer means;
c. a longitudinal passageway extending through the landing nipple;
d. a safety valve releasably secured within the longitudinal passageway for controlling fluid flow therethrough;
e. means for attaching the submersible pump to the landing nipple above the safety valve;
f. the longitudinal passageway providing a portion of the means for directing fluid flow to the pump intake;
g. means for communicating pump discharge pressure to the hydraulically actuated means;
h. means for transmitting torque from the submersible pump through the landing nipple to the well packer means whereby the submersible pump is prevented from rotating with respect to the flow conductor; and
i. a travel joint positioned between the submerisble pump and the means for attaching the submersible pump to the landing nipple.

2. A well completion as defined in claim 1 further comprising means for selectively equalizing fluid pressure between the interior and the exterior of the safety valve while installing and removing the safety valve from the landing nipple.

3. A well completion as defined in claim 1 wherein the means for communicating pump discharge pressure to the hydraulically actuated means comprises:

a. the well packer means providing a barrier between fluid entering the pump intake and fluid exiting the pump discharge;
b. port means extending radially through the landing nipple allowing fluid communication between the exterior and interior of the landing nipple; and
c. a plurality of sealing means carried on the exterior of the safety valve and positioned to straddle the port means when the safety valve is installed within the longitudinal passageway.

4. A well completion as defined in claim 3 wherein the landing nipple further comprises:

a. a tubular housing means with a longitudinal passageway extending therethrough;
b. means for releasably securing one end of the tubular housing means to the upper portion of the well packer means to allow fluid communication through the well packer means to the longitudinal passageway;
c. locking grooves formed on the interior of the longitudinal passageway intermediate the ends thereof;
d. the locking grooves providing means for releasably securing the safety valve within the longitudinal passageway; and
e. the other end of the tubular housing means sized to receive a pump seating mandrel partially within the longitudinal passageway.

5. A well completion having a submersible pump with an intake and a discharge disposed within a well flow conductor comprising:

a. well packer means for forming a fluid seal with the interior of the well flow conductor at a downhole location to direct fluid flow to the pump intake;
b. a landing nipple releasably secured to the upper portion of the well packer means;
c. a longitudinal passageway extending through the landing nipple;
d. a safety valve releasably secured within the longitudinal passageway for controlling fluid flow therethrough;
e. means for attaching the submersible pump to the landing nipple above the safety valve;
f. the longitudinal passageway providing a portion of the means for directing fluid flow to the pump intake;
g. the landing nipple further comprising a tubular housing means with a longitudinal passageway extending therethrough;

h. means for releasably securing one end of the tubular housing means to the upper portion of the well packer means to allow fluid communication through the well packer means to the longitudinal passageway;

i. locking grooves formed on the interior of the longitudinal passageway intermediate the ends thereof;

j. the locking grooves providing means for releasably securing the safety valve within the longitudinal passageway;

k. the other end of the tubular housing means sized to receive a pump seating mandrel partially within the longitudinal passageway;

l. an adapter sub on the one end of the tubular housing means with an outside diameter portion sized to be received within the upper portion of the well packer means;

m. a shoulder on the exterior of the adapter sub sized to engage a matching shoulder on the interior of the well packer means;

n. a plurality of keyways formed in the exterior of the adapter sub and engageble with matching keys on the interior of the well packer means to prevent rotation of the landing nipple relative to the well packer means;

o. packing means carried on the exterior of the adapter sub to form a fluid barrier with the interior of the well packer means; and p. means for releasably locking the adapter sub to the well packer means.

6. A landing nipple for releasably installing a submersible pump and a safety valve at a downhole location within a well flow conductor comprising:

a. a tubular housing means with a longitudinal passageway extending therethrough;

b. means for releasably securing one end of the tubular housing means to the upper portion of a well packer to allow fluid communication through the well packer to the longitudinal passageway;

c. locking grooves formed on the interior of the longitudinal passageway intermediate the ends thereof;

d. the locking grooves providing means for releasably securing the safety valve within the longitudinal passageway;

e. the other end of the tubular housing means sized to receive a pump seating mandrel partially within the longitudinal passageway;

f. port means extending radially through the landing nipple intermediate the ends thereof; and g. the location of the port means selected to allow fluid communication between the exterior of the landing nipple and the safety valve installed within the longitudinal passageway.

7. A landing nipple as defined in claim 6 further comprising:

a. the portion of the longitudinal passageway adjacent to the other end of the tubular housing means having a first inside diameter larger than the inside diameter of the remainder of the longitudinal passageway;

b. a seating shoulder formed on the interior of the longitudinal passageway by the transition between the inside diameters;

c. a plurality of keys on the first inside diameter portion projecting radially inward; and d. a honed sealing surface on a portion of the interior of the longitudinal passageway adjacent to the seating shoulder.

8. A landing nipple as defined in claim 6 wherein the means for releasably securing the landing nipple to the well packer comprises:

a. an adapter sub on the one end of the tubular housing means with an outside diameter portion sized to be received within the upper portion of the well packer;

b. a shoulder on the exterior of the adapter sub sized to engage a matching shoulder on the interior of the well packer;

c. a plurality of keyways formed in the exterior of the adapter sub and engageable with matching keys on the interior of the well packer to prevent rotation of the landing nipple relative to the well packer;

d. packing means carried on the exterior of the landing nipple to form a fluid barrier with the interior of the well packer; and e. means for releasably locking the adapter sub to the well packer.

9. A landing nipple as defined in claim 8 wherein the releasable locking means comprises:

a. flexible collet fingers formed in the exterior of the adapter sub near the extreme end thereof;

b. a boss projecting radially outward from each collet finger intermediate the ends thereof and sized to engage a matching groove in the upper portion of the well packer; and c. a sleeve slidably disposed within the adapter sub having a first position which prevents flexing of the collet fingers and a second position which allows the collet fingers and their associated boss to flex radially inward thereby releasably the landing nipple from the well packer.

10. In a well packer used to form a fluid seal with the interior of a well flow conductor at a downhole location and having a packer bore extending longitudinally therethrough, the upper portion of the well packer comprising:

a. an enlarged inside diameter portion sized to receive the lower end of a landing nipple therein;

b. a plurality of keys projecting radially inward from the enlarged inside diameter portion and engageable with matching keyways on the exterior of the landing nipple;

c. a shoulder on the interior of the packer bore formed by the enlarged inside diameter portion and sized to engage a matching shoulder on the exterior of the landing nipple;

d. a honed sealing surface on part of the enlarged inside diameter portion adjacent to the keys; and e. a groove formed in the bore of the upper portion of the well packer for releasably locking the landing nipple thereto.

* * * * *